United States Patent [19]

Williams, III et al.

[11] Patent Number: 4,460,151

[45] Date of Patent: Jul. 17, 1984

[54] ANNULAR BLOWOUT PREVENTER

[75] Inventors: Bolie C. Williams, III, Houston, Tex.; Richard M. Church, Jr., Patterson, La.

[73] Assignee: Cameron Iron Works, Inc., Houston, Tex.

[21] Appl. No.: 335,504

[22] Filed: Dec. 29, 1981

[51] Int. Cl.[3] ..... E21B 33/06

[52] U.S. Cl. ..... 251/1 B; 251/212; 277/103; 277/188 A; 277/235 R

[58] Field of Search ..... 251/1 B, 212; 277/235 R, 188 A, 31, 38, 103

[56] References Cited

U.S. PATENT DOCUMENTS

| | | | |
|---|---|---|---|
| 2,148,844 | 2/1939 | Stone et al. | 277/73 |
| 2,812,197 | 11/1957 | Gibson | 277/73 |
| 2,846,178 | 8/1958 | Minor | 251/1 R |
| 3,572,627 | 3/1971 | Jones et al. | 251/1 R |
| 3,572,628 | 3/1971 | Jones | 251/1 R |
| 3,667,721 | 6/1972 | Vujasinovic | 251/1 R |
| 3,897,071 | 7/1975 | LeRovax | 251/1 R |
| 3,915,426 | 10/1975 | LeRovax | 251/1 R |
| 3,994,472 | 11/1976 | Williams | 251/1 R |
| 4,007,904 | 2/1977 | Jones | 251/1 B |
| 4,092,010 | 5/1978 | Carlson, Jr. | 251/4 |
| 4,099,699 | 7/1978 | Allen | 251/1 B |
| 4,310,139 | 1/1982 | Williams III et al. | 251/1 B |

FOREIGN PATENT DOCUMENTS

| | | | |
|---|---|---|---|
| 584298 | 9/1959 | Canada | 251/212 |

*Primary Examiner*—Martin P. Schwadron
*Assistant Examiner*—Sheri Novack
*Attorney, Agent, or Firm*—Vinson & Elkins

[57] ABSTRACT

An annular blowout preventer having a housing with a vertical bore therethrough, a packer within the housing including a resilient annulus and upper and lower series of irising metal inserts adapted to increase the support for the annulus when it is deformed axially and extended radially to constrict the vertical bore, a support ring in the annulus under the outer ends of the irising metal inserts to support against upward movement of the inner ends of the inserts on closing of the annulus and an annular piston movable in the housing to apply an axial deformation load to the packer to move it to closed position sealing the bore.

7 Claims, 5 Drawing Figures

ANNULAR BLOWOUT PREVENTER

BACKGROUND

Blowout preventers are used to control pressure within oil and gas wells during drilling and completion. Annular blowout preventers, the type to which the present invention relates, include a single annular resilient packing positioned within a body having means to cause the packing to move into sealing engagement with a portion of a pipe string extending through the preventer or against itself to seal a well when no pipe string extends through the preventer.

An annular blowout preventer is shown and described in U.S. Pat. No. 3,572,627 to Jones et al. The packer has a resilient annulus with a circular series of rigid inserts extending through the packer and having irising end flanges on both ends which move to provide end support for the resilient annulus when it is compressed radially inward by pistons. The pistons are positioned around the resilient annulus to provide an inwardly directed radial force on the resilient annulus. Other annular preventers have utilized an axial deformation of the resilient annulus to cause it to move radially inward to sealing position. U.S. Pat. Nos. 4,099,699, 2,387,205, 3,667,721, 3,323,773, 2,148,844, 2,812,197 and 2,846,178 are examples of annular blowout preventers of the prior art. Additionally, U.S. patent application Ser. No. 06/137,549, filed Apr. 4, 1980 entitled Annular Blowout Preventer is a more recent example of the type of structure to which the present application applies as an improvement.

The application of an axial force on the resilient annulus of an annular blowout preventer is simpler and less expensive than the application of a relatively uniform radial force to the resilient annulus. As set forth in the above-identified patent application, the use of an axial force on the resilient annulus of the patent to Jones et al would not be suitable as the rigid inserts would prevent effective axial deformation of the annulus. Without the stems extending from the upper to the lower end flanges, it has been noticed that the inserts can be subject to tilting about the upper shoulder when the annulus has been axially compressed into sealing position.

SUMMARY

The present invention provides an improved annular blowout preventer with an improved annular packer. The preventer includes a housing, an annular packer, and a piston for application of an axial force to the annular packer. The packer includes a resilient annulus with a circular series of rigid inserts having inner stems extending into the inner portion of the annulus, said inserts being embedded in its upper surface so that the inner ends of the inserts move inward as the resilient annulus moves inward to provide upper support for the resilient annulus and a supporting ring between the annulus and the outer edge of said inserts. Another circular series of inserts may be embedded in the lower face of the resilient annulus.

An object of the present invention is to provide an improved annular blowout preventer of simple construction and relatively long service life.

Another object is to provide an improved annular packer for an annular blowout preventer having adequate upper support when the resilient annulus is moved inwardly.

A further object is to provide an improved packer which has improved protection from extrustion when closed and holding pressure.

A still further object is to provide an improved annular blowout preventer which can be actuated many times to sealed position without incurring such damage as would render it unfit for continued use.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
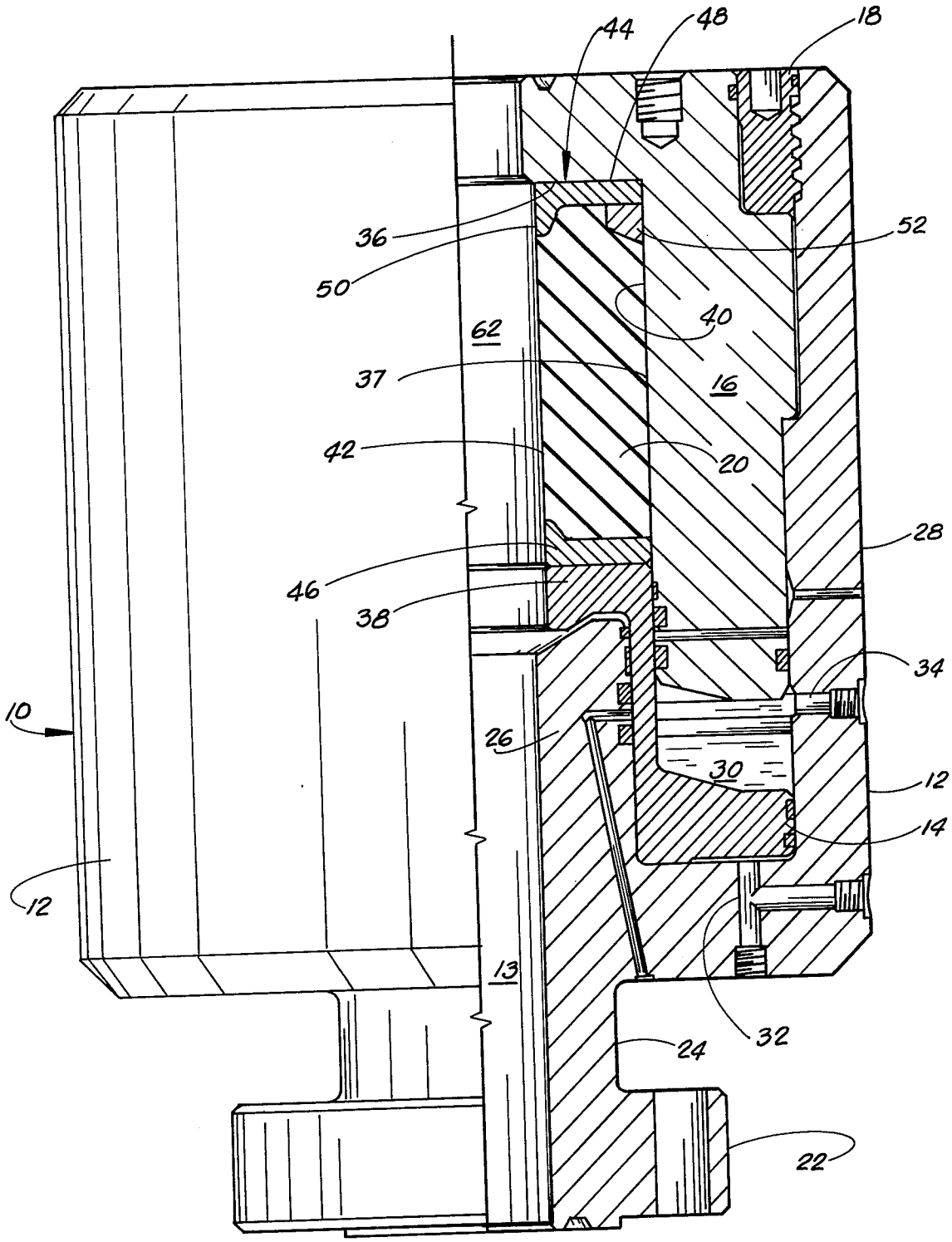
FIG. 1 is a view partly in elevation and partly in section of the preferred form of the improved annular blowout preventer of the present invention with its packer in relaxed or open position.
Figure 2:
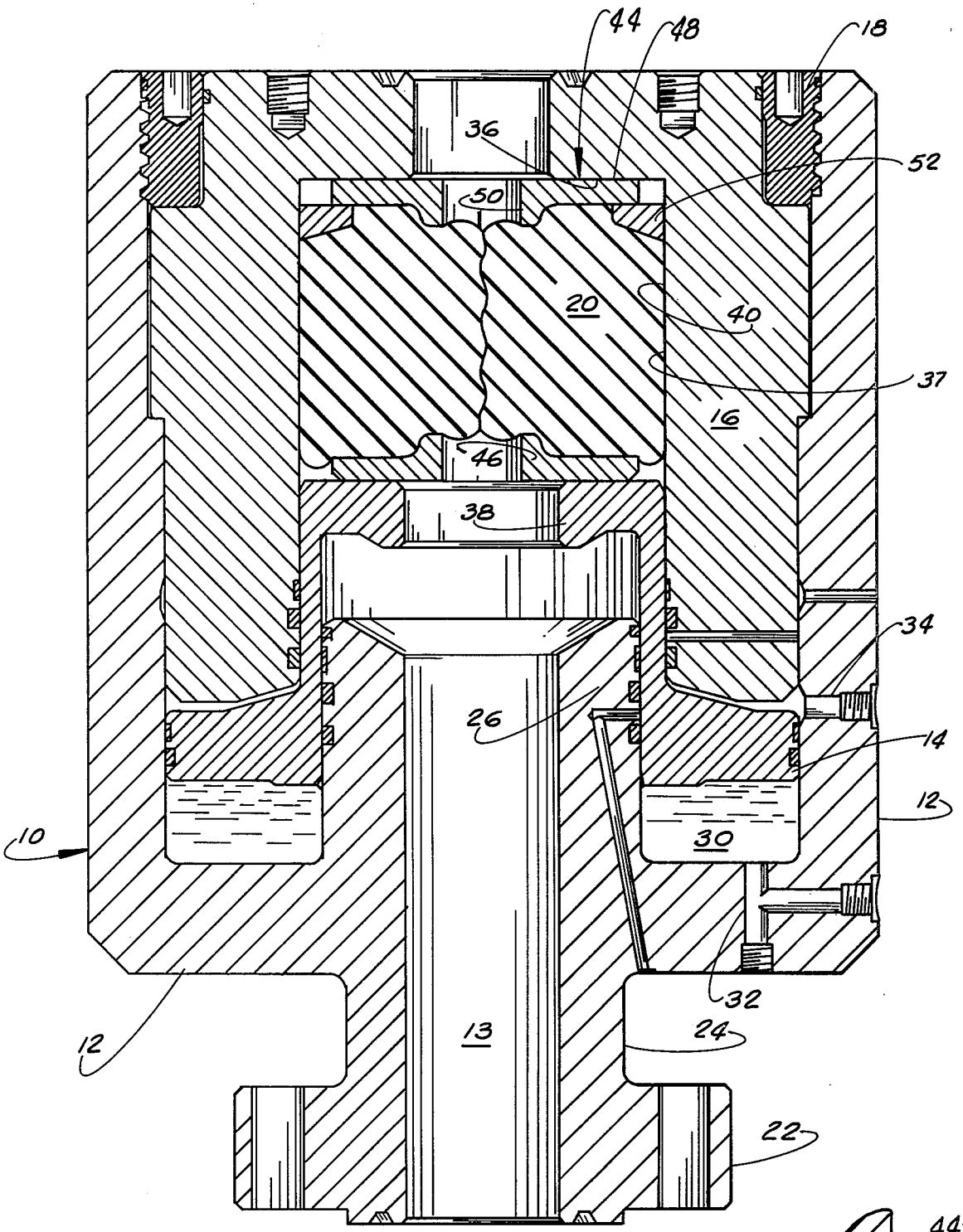
FIG. 2 is a view similar to FIG. 1 but showing the preventer packer in closed, sealed position.

Improved annular blowout preventer 10 as shown in FIGS. 1 and 2 includes annular housing 12 with vertical bore 13 therethrough, annular piston 14, retainer ring 16, lock ring 18 and packer 20. Housing 12 includes lower flange 22 connected to neck 24, annular ring 26 extending upwardly from neck 24 and exterior annular housing section 28 which extends radially outward from neck 24 and upwardly around and spaced from rim 26. Chamber 30 is the annular space between rim 26 and section 28 below the lower end of retainer ring 16. Piston 14 is movably positioned partially within chamber 30 as shown. Passage 32 extends through housing section 28 into chamber 30 to deliver fluid under pressure to the lower side of piston 14 causing it to move upward and to exhaust fluids as piston 14 moves downward. Passage 34 extends through housing section 28 into chamber 30 to deliver fluid under pressure to the upper side of piston 14 causing it to move downward and to exhaust fluids as piston 14 moves upward.

Packer 20 is annular in shape, as hereinafter described, is positioned within recess 37 below shoulder 36 of retainer ring 16 and above the upper end of annular arm 38 of piston 14 which engages the lower end of packer 20. Thus, as piston 14 moves upward, its arm 38 exerts an axial force on packer 20. Shoulder 36 prevents upward movement of packer 20 and inner surface 40 of retainer ring 16 prevents radial outward movement of packer 20 whereby the packer is moved to its closed or sealed position as shown in FIG. 2.

Figure 3:
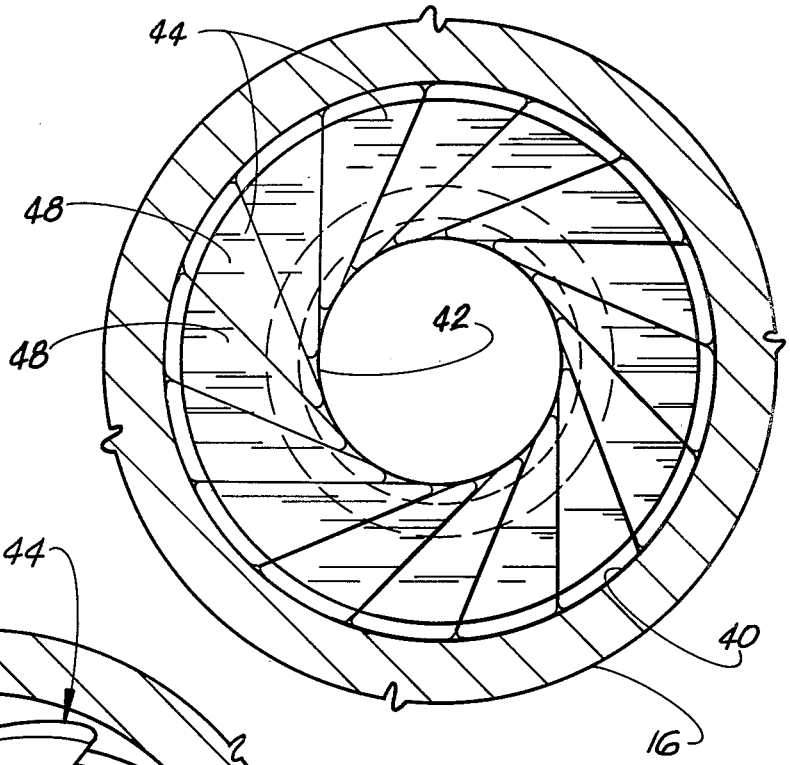
FIG. 3 is a top plan view of the packer in its relaxed or open position.
Figure 4:
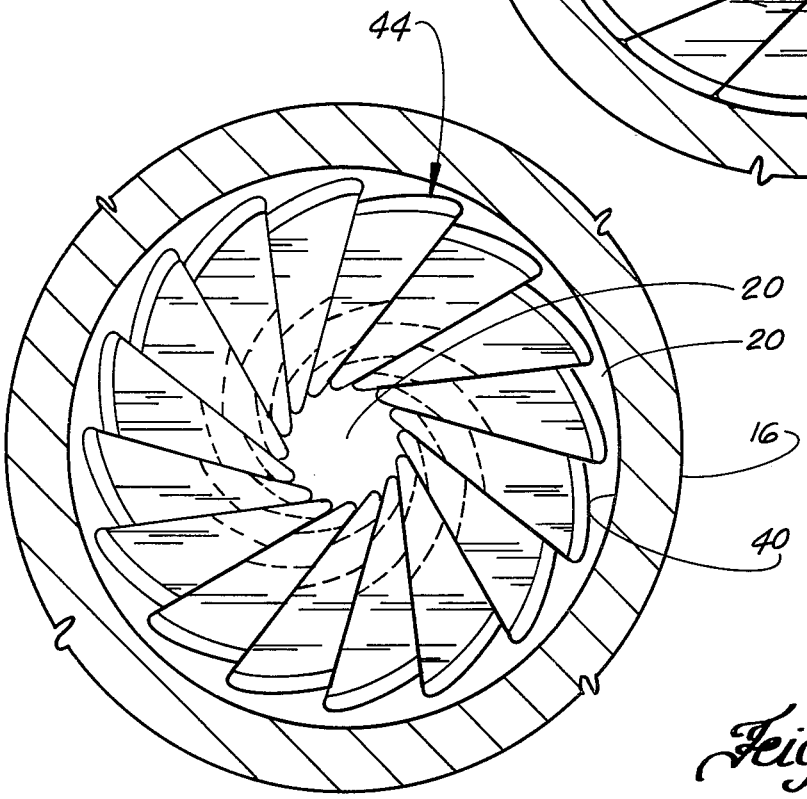
FIG. 4 is a view similar to FIG. 3 with the packer in its closed or sealing position.

Packer 20 is illustrated in greater detail in FIGS. 3 and 4 and includes resilient annulus 42, an upper circular series of rigid inserts 44 arranged on, bonded to, and embedded in the upper surface of annulus 42 and a lower circular series of rigid inserts 46 bonded to the lower surface of and embedded in annulus 42. Each rigid insert 44 includes flat, triangular shaped body 48 with stem 50 depending from the inner or apex end of body 48. Stem 50 extends downward within the inner portion of annulus 42 and is sufficiently long to ensure that it is moved inwardly with the movement of the annulus and to ensure that the inner end of the body 48 is pivoted inwardly as shown in FIG. 4. Also, stem 50 terminates a substantial distance from the upper ends of the stems of lower inserts 46 so that a sufficient axial length of annulus 42 is unrestricted to allow it to seal as shown in FIG. 2. In the relaxed open position of annulus 42, as shown in FIG. 3, the triangular shaped bodies 48 are skewed to the axis of the packer and abut each other so that as the annulus moves to closed position, as shown in FIG. 4, the inserts 44 are caused to rotate in irising fashion to less skewed positions and to move radially inward. This increases support for the annulus by increasing the effective radial lengths (i.e., radial extents) of the inserts.

Rigid inserts 46 may be the same as inserts 44 or may be substantially the same as inserts 44 except that, as shown in FIG. 4, they are the reverse of inserts 44 so that they have the same relative movement as inserts 44. It is believed that using rigid inserts 46 which are identical to inserts 44 may be advantageous. When actuated the opposite rotation of inserts 46 from inserts 44 will impart a slight twist to annulus 42. This twisting of annulus 42 is believed to assist annulus 42 in opening.

Support ring 52 is embedded in the exterior of resilient annulus 42 immediately below the outer portion of the bodies 48 of the inserts 44. As shown in FIG. 2, said support rings being positioned between the resilient annulus and the outer ends of the inserts 44 will assist and support the inserts when the blowout preventer is moved to sealing position. This ensures that the inner ends of inserts 44 do not tilt upwardly within the interior of the bore through retainer ring 16. This support for the inserts 44 thus allows the inserts to continuously support the resilient annulus 42 until it has moved completely into sealed position.

As discussed, the movement of resilient annulus 42 when axially deformed by the movement of annular piston 14, causes a pivoting movement of body 48 of inserts 44 to provide the support for the upper end of resilient annulus 42. This movement of bodies 48 can be termed an irising action since it does cause a reduction in the inside diameter of the effective support by the inserts 44. Inserts 46 have a similar irising action.

Figure 5:
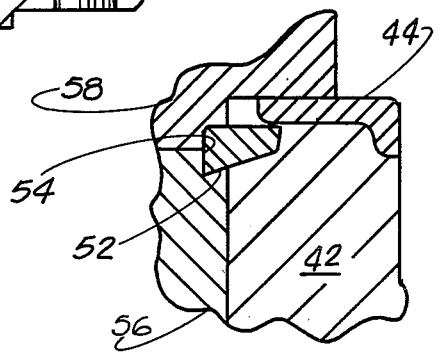
FIG. 5 is a partial sectional view of a modified form of packer of the present invention.

The modified form of the invention shown in FIG. 5 includes the resilient annulus 42' having upper inserts 44' and support ring 52' which is held in groove 54 in the inner surface of retainer ring 56 by the retainer ring cap 58 which is suitably secured to retainer ring 56. This clamping of the support ring 52' in groove 54 between members 56 and 58 provides continuous support for the outer portions of the inserts 44' and ensures that the support ring 52' is not moved by the movement of the resilient annulus 42'.

During normal well operations piston 14 is in its lower position and packer 20 is relaxed providing a full bore 62 which is at least as large as bore 13 as shown in FIG. 1. When it is desired that preventer 10 be closed, pressure is supplied through passage 32 into chamber 30 and passage 34 is connected to a suitable exhaust (not shown). This causes piston 14 to move upward so that arm 38 compresses packer 20. This axial deformation moves resilient annulus 42 inwardly as shown in FIG. 2. Also, inserts 44 and 46 pivot to the position shown in FIGS. 2 and 4 to increase the support for the central portion of the annulus. The inclusion of support ring 52 ensures this additional support throughout the complete axial deformation movement of packer 20. Relaxation of annulus 42 is provided by relieving the pressure under piston 14 through passage 32 and applying pressure above piston 14 through passage 34. This causes piston 14 to move to the position shown in FIG. 1 and allows packer 20 to return to its full open position.

What is claimed is:

1. A packer for use in an annular blowout preventer having means for axially deforming the packer comprising an annulus of resilient material having an inner periphery, a ring embedded around the upper exterior of said annulus, and a substantially circular series of rigid inserts arranged on and bonded to the upper end of the annulus, each insert having a flat body portion and a stem portion depending from the inner end of the body portion, the flat body portion of said inserts lying in a plane generally perpendicular to the axis of said annulus with the radial outermost portions overlying said ring and with the radially innermost ends of the body portions being substantially adjacent to the inner periphery of said annulus when the annulus is unconstricted and being generally triangular shaped, skewed to the packer axis and in abutment with each other, said stem portion extending a distance downward in the annulus substantially less than the compressed length of the annulus when constricted, a portion of the resilient annulus is positioned between the ring and the stem portions of the inserts, said inserts being responsive to the axial compression of said annulus to cause them to pivot to a position with their inner ends supporting a reduced inner diameter of said annulus as said inner periphery is constricted with radial inward extension of said annulus when it is deformed axially and having their outer ends supported by said ring to ensure that the inner portions do not pivot in an axial direction when said annulus is constricted.

2. A packer according to claim 1 including a substantially circular series of rigid inserts which are arranged on and bonded to the lower end of the resilient annulus.

3. A packer according to claim 2 wherein said lower inserts are identical to said upper inserts.

4. A packer according to claim 2 wherein said lower inserts are the reverse of said upper inserts.

5. An annular blowout preventer comprising an annular housing having an axially extending annular chamber therein, and ports extending through said housing into opposite ends of the chamber, means providing an inwardly projecting, downwardly facing shoulder within said housing, an annular packer within said housing with one end against said shoulder, alternate application of pressure to opposite ends of said chamber moving said piston against said packer to squeeze it between the piston and said shoulder into inwardly sealing position and away from the said shoulder to allow said packer to relax to its open position, said packer comprising a resilient annulus having an inner periphery, a ring embedded around the upper exterior of said annulus, and a substantially circular series of rigid inserts which are responsive to movement of said resilient annulus and which their radially outermost ends overlying and supported by said ring and their radially innermost ends substantially adjacent said inner periphery when the resilient annulus is unconstricted and being generally triangular shaped, skewed to the packer axis and in abutment with each other, and having an increased thickness in their inner ends to cause them to pivot so that their inner ends move inwardly and their outer ends remain supported by said ring as the resilient annulus is constricted, a portion of the resilient annulus is positioned between the ring and the stem portions of the inserts.

6. An annular blowout preventer comprising a housing with a vertical bore therethrough and having an axially extending annular chamber, and means providing an inner shoulder facing in the direction of the annular chamber within said housing, an annular resilient packer within said housing and against said shoulder, an annular piston positioned in said chamber and having an arm extending from said chamber to engage the end of said packer away from said shoulder, means for delivering and exhausting fluids under pressure from opposite sides of said piston within said chamber to cause axial movement of said piston, said packer including a resilient annulus having an inner portion and an outer portion, a substantially circular series of irising inserts embedded in the upper end of said annulus, skewed to the packer axis and in abutment with each other, and a support ring to the upper outer portion of said annulus supporting the radially outermost portions of said inserts, said inserts having triangular shaped flat bodies and stems extending from the inner apex end of the bodies, said stems extending through the inner portion of the annulus a sufficient distance to ensure that the inserts are moved inwardly in an irising action with the inward extension of the resilient annulus, and terminating a sufficient distance from the opposite end of annulus to ensure that a sufficient amount of said annulus is unrestricted for sealing responsive to axial compression, a portion of the resilient annulus is positioned between the ring and the stem portions of the inserts.

7. An annular blowout preventer according to claim 6 wherein said housing has a groove in the surface forming said annular recess and said ring is positioned in said groove.

* * * * *

UNITED STATES PATENT AND TRADEMARK OFFICE

CERTIFICATE OF CORRECTION

PATENT NO. : 4,460,151

DATED : July 17, 1984

INVENTOR(S) : Bolie C. Williams, III and Richard M. Church, Jr.

It is certified that error appears in the above—identified patent and that said Letters Patent is hereby corrected as shown below:

Column 4, between lines 54 and 55 insert -- an annular piston in said chamber having an arm engaging the end of the packer opposite to the end engaging said shoulder --.

Signed and Sealed this

*Twenty-eighth* Day of *January 1986*

[SEAL]

*Attest:*

DONALD J. QUIGG

*Attesting Officer*

*Commissioner of Patents and Trademarks*